US005156394A

United States Patent [19]

Deal

[11] Patent Number: 5,156,394

[45] **Date of Patent: * Oct. 20, 1992**

[54] BASKETBALL HOOP VISUAL GUIDE

[76] Inventor: Richard E. Deal, 614 S. Moore, Algona, Iowa 50511

[ * ] Notice: The portion of the term of this patent subsequent to Feb. 12, 2008 has been disclaimed.

[21] Appl. No.: 597,561

[22] Filed: Oct. 15, 1990

Related U.S. Application Data

[63] Continuation-in-part of Ser. No. 409,246, Sep. 19, 1989, Pat. No. 4,991,837.

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,520,196 | 12/1924 | Medart et al. | 273/1.5 R |
| 1,544,453 | 6/1925 | Harbison | 273/1.5 R |
| 2,579,312 | 12/1951 | Garvey | 273/1.5 R |
| 3,085,800 | 4/1963 | Holstad | 273/1.5 A |
| 3,109,647 | 11/1963 | Austin | 273/1.5 R |
| 3,160,245 | 12/1964 | Gray | 273/1.5 R |
| 3,814,421 | 6/1974 | Spier, Jr. | 273/1.5 R |
| 4,082,269 | 4/1978 | Hill | 273/1.5 R |
| 4,244,569 | 1/1981 | Wong | 273/1.5 R |
| 4,353,548 | 10/1982 | Mahoney | 273/1.5 R |
| 4,805,903 | 2/1989 | McArdle | 273/1.5 R |
| 4,834,368 | 5/1989 | Qualley | 273/1.5 R |
| 4,836,539 | 6/1989 | Knapp | 273/1.5 R |
| 4,903,964 | 2/1990 | Anderson | 273/1.5 R |
| 4,905,995 | 3/1990 | Apo | 273/1.5 R |
| 4,991,837 | 2/1991 | Deal | 273/1.5 R |

*Primary Examiner*—Paul E. Shapiro
*Attorney, Agent, or Firm*—Zarley, McKee, Thomte, Voorhees & Sease

[57] ABSTRACT

A visual guide for improving accuracy of shooting a basketball into a basketball hoop is shown which consists of an annular member which extends below the rim of the basketball hoop. The annular member provides a visual guide as to the location of the rim and the opening for shooting the basketball. The annular member may be mounted by any one of a variety of devices onto the hoop so that the annular member extends below the rim. Such mounting devices may include, for example, a lip or series of lips, a plurality of holes throughout the annular member and a rope looped through those holes and the net holding device, a tab with a snap looped over the net holding device, a hook extending upwardly from the annular member to be engaged with the rim of the basketball hoop, or a series of loops attached to the interior of the annular member with a mounting rope threaded through the net holding means and through the loop. The annular member may also be woven in and out of the loops of the net.

17 Claims, 7 Drawing Sheets

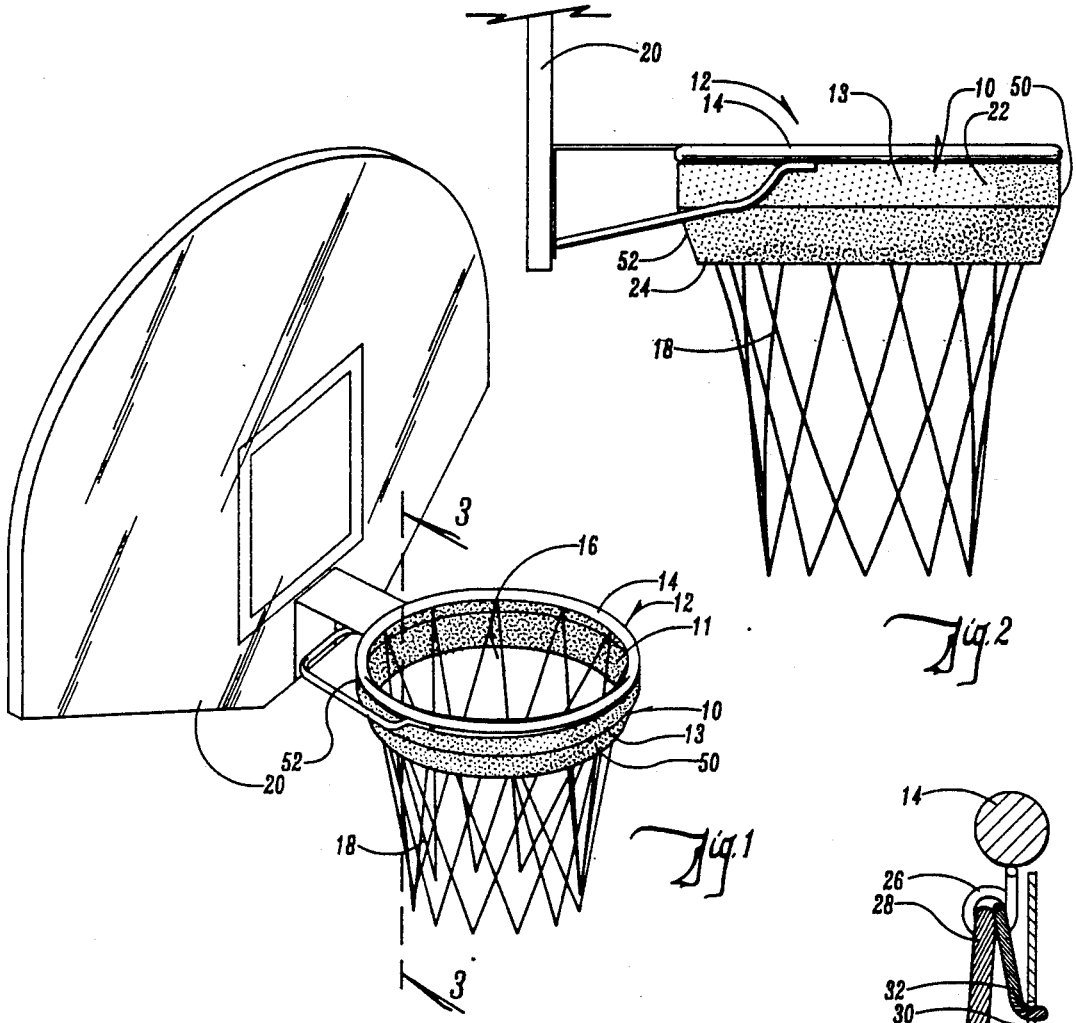
Fig. 2
Fig. 1
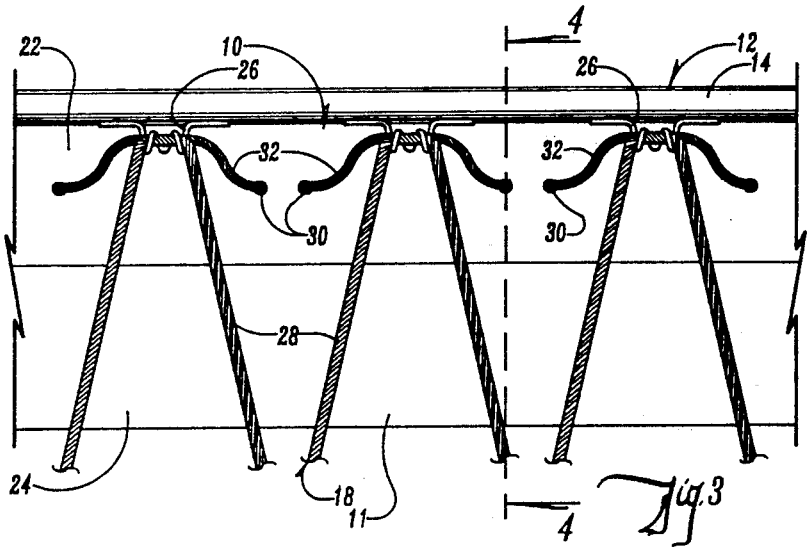
Fig. 3
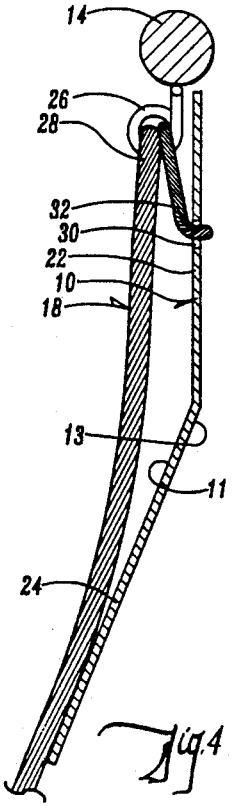
Fig. 4

19
10
20
12
68
88
90
82
84
72
60
14
92
10
76
13
64
92
74
19
18
86

20
18
12
78
16
72
60
11
68
64
70
74
82
10
76
13
18
18

72
60
14
93
15
26
11
92
13
88
82
84
90
86
18
74

12
68
70
60
16
14
72
78
11

BASKETBALL HOOP VISUAL GUIDE

BACKGROUND OF THE INVENTION

This application is a Continuation-In-Part of my earlier copending application, U.S. Ser. No. 07/409,246, filed Sept. 19, 1989 now U.S. Pat. No. 4,991,837.

A conventional basketball hoop which is mounted with a backboard in an elevated position on a pole consists of a rim attached to the backboard and netting which extends downwardly and inwardly from the rim. The rim is narrow and horizontally positioned. When shooting basketballs, it is somewhat difficult to coordinate view of the thin, raised rim and movement of the arms and hands to propel the basketball into the opening in the rim. This invention relates to a device designed to aid in improving shooting accuracy by providing an enhanced visual guide as to the location and orientation of the rim and the opening. It provides a target area for which the player may shoot in order to improve shooting accuracy.

Therefore, it is a primary object of this invention to provide for a device which provides a visual guide for shooting basketballs into a basketball hoop.

A further object of the invention is to provide for a visual guide in improving accuracy of shooting basketballs into a basketball hoop.

Another object of the invention is to provide for a visual guide for improving shooting accuracy of basketballs into a basketball hoop which is distinctive and easy to see.

Yet another object of the invention is to provide for a device for improving accuracy of shooting basketballs into a basketball hoop which is easily mounted onto the basketball hoop.

Still further objects of the invention will become apparent in the following disclosure.

SUMMARY OF THE INVENTION

The invention relates to a visual guide which consists of an annular member capable of being mounted below the rim of the basketball hoop and extending downwardly from the rim. The device enhances visual identification of the rim and opening in the rim. The device may be mounted on the basketball hoop by any one of a variety of means or methods. These include providing a lip to attach to the rim, holes within the annular member for threading a rope, a snap on the annular member to loop over the rim of the hoop, a hook extending upward from the annular member to hook onto the rim, or providing a loop fastened to the inside of the annular member for threading a rope.

DESCRIPTION OF THE DRAWINGS

FIG. 1 is a perspective view of an embodiment of the device of this invention mounted onto a basketball hoop.

FIG. 2 is a side elevational view of the device of this invention mounted onto a basketball hoop.

FIG. 3 is a sectional view taken along line 3—3 of FIG. 1 of the interior of the basketball hoop showing a mounting means of the device of this invention.

FIG. 4 is a sectional view taken along line 4—4 of FIG. 3.

DETAILED DESCRIPTION OF THE INVENTION

Figure 5:
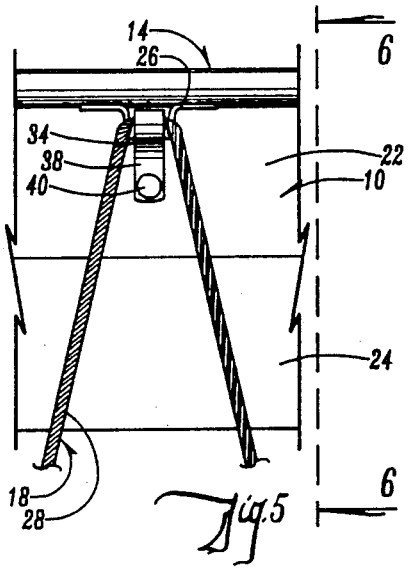
FIG. 5 is a partial interior view of the device of this invention showing a second embodiment of the mounting means.

The visual guide device, according to the present invention, is an annular member represented as 10. It is shown in FIGS. 1 and 2 mounted on a basketball hoop 12 Annular member 10 has an interior surface 11 and exterior surface 13. The basketball hoop 12 consists of a rim 14 which provides an opening 16 for shooting basketballs into. Descending downwardly from the rim 14 and sloping inward is netting 18. The hoop 12 is attached by any one of a variety of means to a backboard 20, which is then typically mounted on a vertical pole (not shown) to elevate hoop 12 and backboard 20 (typically to approximately 10 feet above the ground or floor).

The annular member 10 provides a visual guide by extending downwardly from the bottom of rim 14. The exact length that the annular member 10 extends downward from the rim 14 is not critical, as long as it forms a sufficient visual guide as to the location of the rim 14 and consequently the opening 16. The circumference of annular member 10 in this embodiment is such that it is greater than the maximum circumference of netting 18 so that the annular member 10 may surround the upper portion of netting 18. As can also be seen in FIGS. 4 through 10, for all embodiments shown, the annular member 10 is of thin cross-section. For ornamental purposes, it is possible to provide that the annular member 10 descends from the rim 14, and then slopes inwardly toward netting 18. This provides for an attractive configuration in combination with basketball hoop 12. Member 10 is shown more particularly in FIG. 2 as including an upper portion 22 which extends downward from the rim 14 and a lower portion 24 which then slopes inwardly. It is clear that a number of variations upon the exact configuration and shape of the annular member 10 are possible so that it provides a visual guide. The annular member 10 may be made of any of a variety of materials suitable for purposes of use in basketball and for the environment in which basketball hoops are placed, both indoors and outdoors, and, for example, may be made of rigid material, such as stiff plastic to provide for an inexpensive and durable annular member 10. It also may be made of rubber or rubber-like material, for example, such as polyvinylchloride.

Annular member 10 is mounted to the basketball hoop 12 by any one of a variety of different means, so that the annular member 10 extends downward from rim 14. Several different embodiments are shown in the drawings for mounting the annular member 10 onto the basketball hoop 12.

FIGS. 3 and 4 demonstrate one embodiment of the mounting means. In FIG. 3, it can be seen that the netting 18 is held in place on the basketball hoop 12 by a plurality of net holding means here shown as eyelets 26. These eyelets 26 are attached to the underside of rim 14 at spaced apart positions around the rim. Each eyelet 26 loops back onto itself so that the netting rope 28 may be slipped into eyelet 26 and held in place thereby. In this embodiment, a plurality of holes 30 are provided throughout the annular member 10. A mounting rope 32, which may be similar to the netting rope 28, is then looped through these holes 30 and the mounting rope 32 is guided through the eyelet 26. This would allow an existing device, the eyelet 26, to be used for mounting annular member 10 below rim 14.

Figure 6:
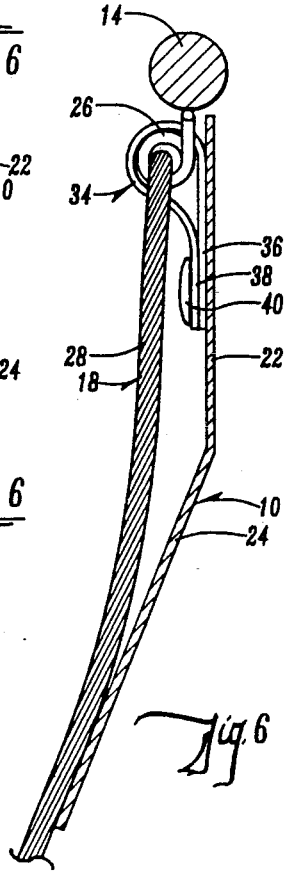
FIG. 6 is a sectional view taken along line 6—6 of FIG. 5.

FIGS. 5 and 6 demonstrate a second embodiment of a mounting means of the invention A flexible elongated tab 34 is shown having a first end 36 and a second end 38. First end 36 is fixedly mounted to the interior side 11 of annular member 10. Second end 38 of tab 34 has thereon a snap 40. It is capable of engaging a mating member on the interior surface of first end 36 (not shown). In this manner, the tabs 34, at spaced apart locations around member 10 coincident with means 26 around rim 14 may be looped over eyelet 26 and snaps 40 engaged in order to hold the annular member 10 below rim 14.

Figure 7:
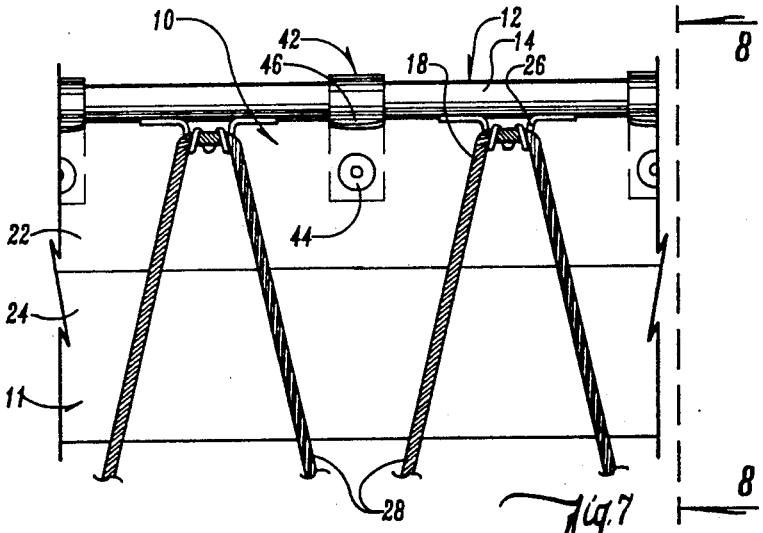
FIG. 7 is a partial interior view of the device of this invention showing a third embodiment of a mounting means of the device of this invention.
Figure 8:
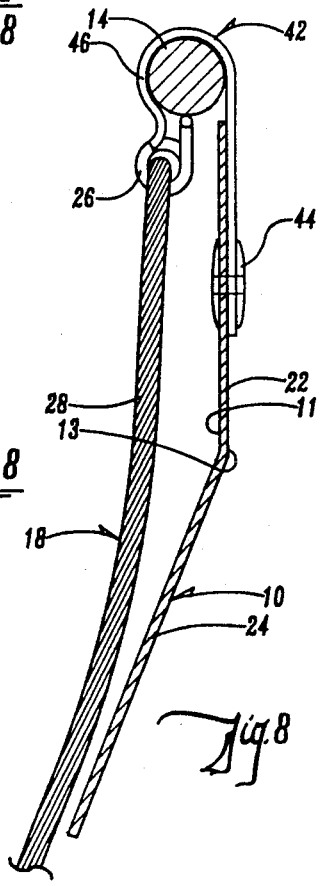
FIG. 8 is a sectional view taken along line 8—8 of FIG. 7.

A third embodiment of the mounting means is shown in FIGS. 7 and 8. A plurality of hooks 42 are fixedly mounted at spaced apart locations around annular member 10. Hooks 42 may be mounted to either the exterior 12 or interior 11 of annular member 10. In the embodiment shown, hooks 42 are mounted by means of rivets 44 to the exterior side 12 of annular member 10. The hooks 42 are attached such that the arch portion 46 faces the interior side 11 of annular member 10. Hooks 42 are then attached to the rim 14 by mounting arched portion 46 on top of rim 14. This then allows the annular member 10 to extend below rim 14. It also allows annular member 10 to be mounted to rim 14 independent of eyelets 26. The hooks 42 can be hooked onto rim 14 at locations intermediate of eyelets 26.

Figure 9:
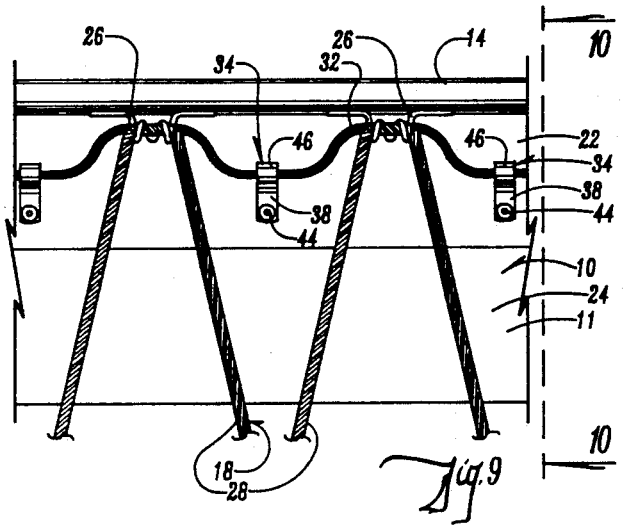
FIG. 9 is a partial interior view showing a fourth embodiment of a mounting means of the device of this invention.
Figure 10:
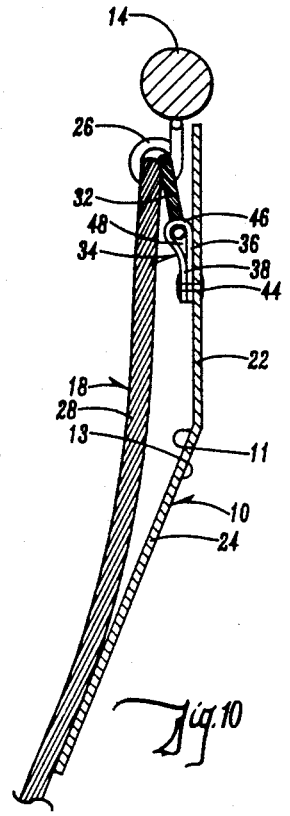
FIG. 10 is a sectional view taken along line 10—10 of FIG. 9.

Yet another embodiment of a mounting means is shown in FIGS. 9 and 10. This also employs a plurality of tabs 34 forming loops attached at spaced apart positions to the interior side 11 of annular member 10. However, instead of being provided with snaps, both first end 36 and second end 38 of tabs 34 are rigidly attached to the interior of annular member 10 by means of a rivet 44 to form a loop. A mounting rope 32 is then threaded through the plurality of eyelets 26 and openings 48 provided by tabs 34. By placing the tabs 34 on the interior surface 11, the appearance of the annular member 10 while on the hoop 12 is enhanced.

Still another mounting means could include mounting Velcro® strips to the annular member to pass over rim 14 or eyelets 26.

Figure 11:
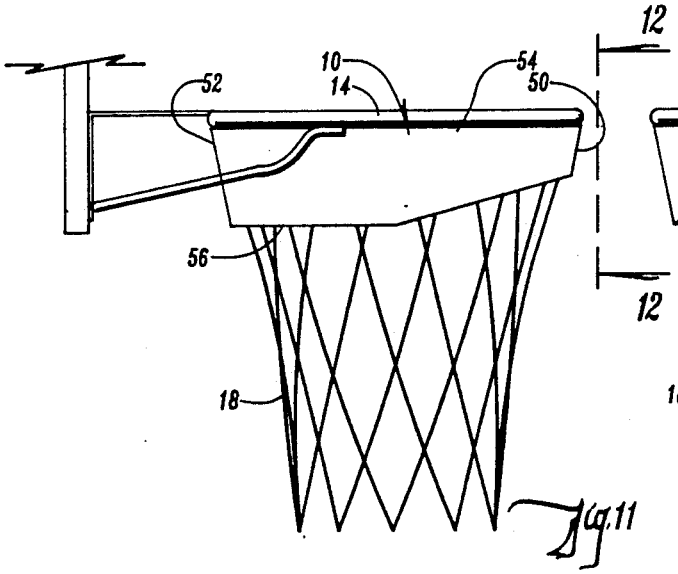
FIG. 11 is a side elevational view of another embodiment of the visual guide of this invention.
Figure 12:
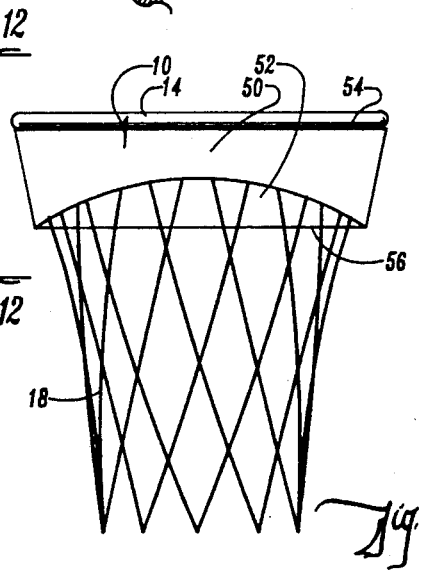
FIG. 12 is a front elevational view of an embodiment of the visual guide of this invention along line 12—12 of FIG. 11.
Figure 13:
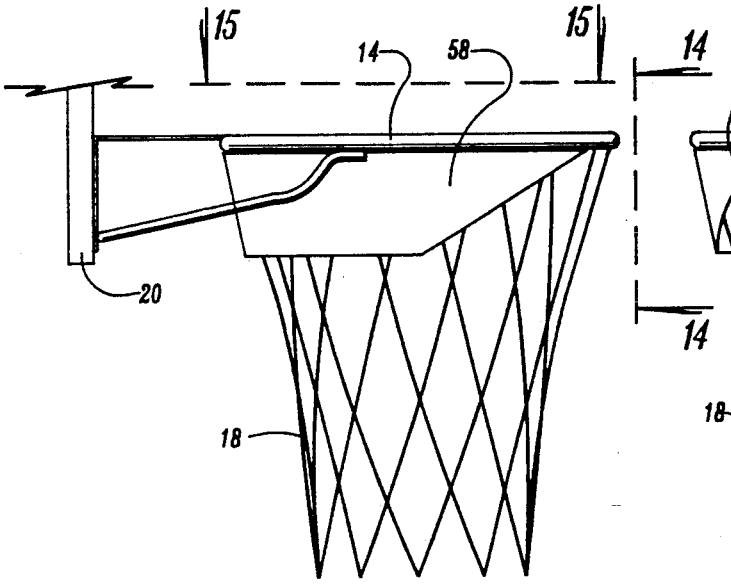
FIG. 13 is a side elevational view of another embodiment of the visual guide of this invention.
Figure 14:
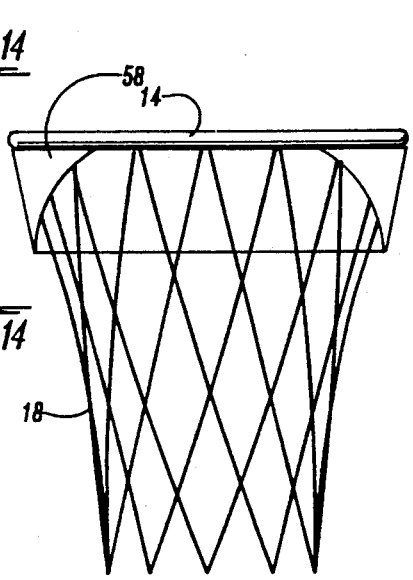
FIG. 14 is a front elevational view taken along line 14—14 of FIG. 13.
Figure 15:
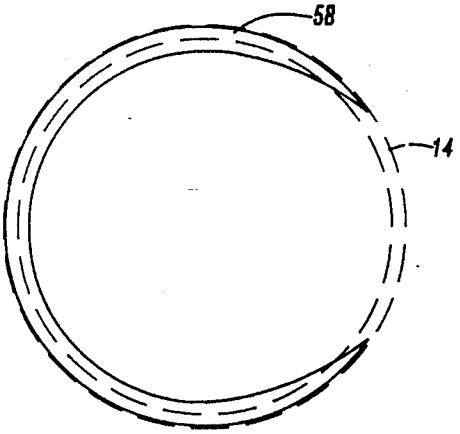
FIG. 15 is a top sectional view taken along line 15—15 of FIG. 13.

To further enhance the visual impact of the annular member 10, the interior surface 11 may be a different color than exterior surface 12 of the member 10. The contrast may be enhanced in other ways, as by contrasting surfaces interior and exterior, or varying thickness of annular member 10 with the forward half 50 shorter than rearward half 52. This embodiment may be seen in FIGS. 11 and 12. Here it can be seen that the forward portion 50 is thinner from the top 54 of annular member 10 to the bottom 56 of the annular member, than is the rearward portion 52. Yet another embodiment is shown in FIGS. 13 through 15. Here, a member 58 is shown which forms a partial circle. This is best seen in FIG. 15. Of course, this member may be an annular member 10 which has been cut, or may be a preformed partially circular member. It also may be shorter in the front portion as compared to the rearward portion, as shown.

Figures 16, 17, 18, 19:
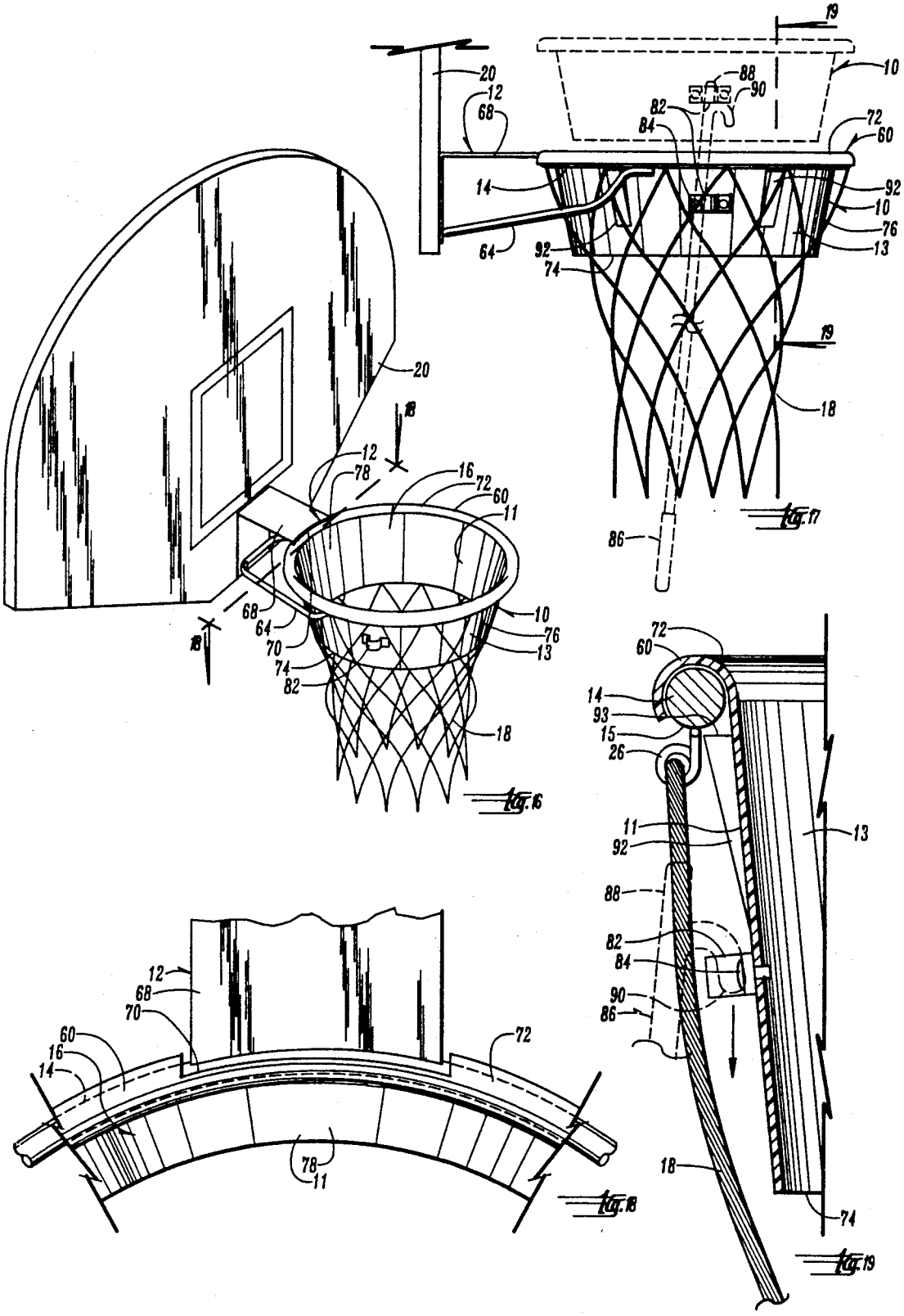
FIG. 16 is a perspective view of an embodiment of the device of this invention mounted on a basketball hoop.
FIG. 17 is a side elevational view of the device of this invention mounted onto a basketball hoop.
FIG. 18 is a sectional top plan view taken along line 18—18 of FIG. 16.
FIG. 19 is a sectional view taken along line 19—19 of FIG. 17.

Yet another embodiment is depicted in the variations in FIGS. 16 through 33 which show an embodiment where the annular member 10 is contained inside the netting 18 As best seen in FIG. 16, annular member 10 is completely inside netting 18, and the mounting member at the top consists of an extension upward of the annular member 10 which arches outward to form a continuous lip 60. Lip 60 rests upon rim 14 as best seen in FIG. 17 and holds the device in place.

As can be seen in FIG. 16, the basketball hoop 12 is connected to a backboard 20 by a variety of support mechanisms. Here, the support mechanisms include a support bar 64 which extends outward from the backboard 20 and attaches to the rear of rim 14. It further includes a bracket 68 extending upward from the backboard 20 and attaching to the sides of rim 14. In order to accommodate these support mechanisms, indentations 70 are provided in the lip 60 at the appropriate point. As can be seen in FIG. 18, at the rear of lip 60, an indentation is provided in mating configuration with support bar 64. Side indentations 70 accommodate the attachment of the bracket 68. Obviously, there are many variations which may occur to lip 60 in order to accommodate any of a number of means of supporting the basketball hoop 12.

Figure 20:
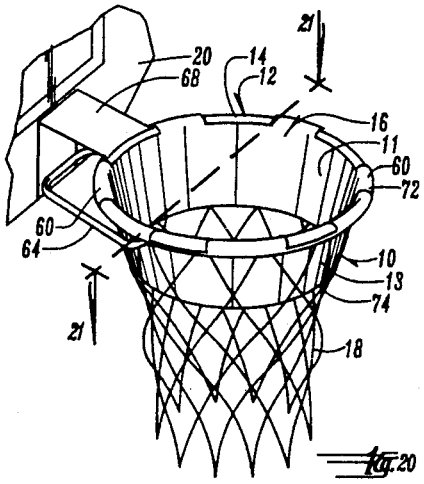
FIG. 20 is a perspective view of an embodiment of the device of this invention mounted onto a basketball hoop.
Figure 21:
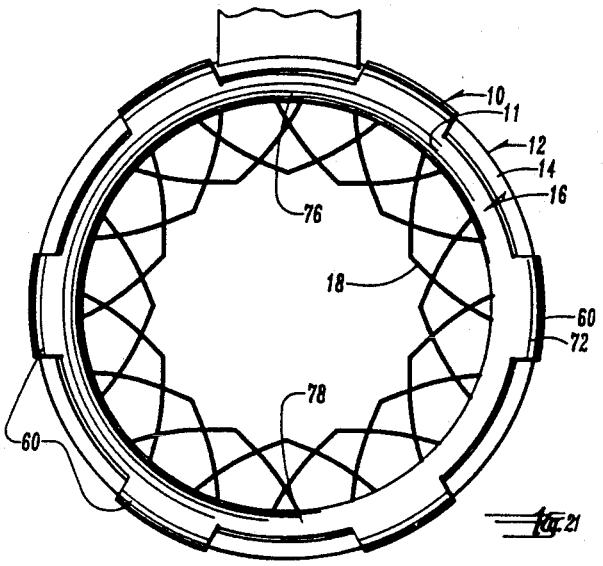
FIG. 21 is a sectional top plan view taken along line 21—21 of FIG. 20.
Figure 23:
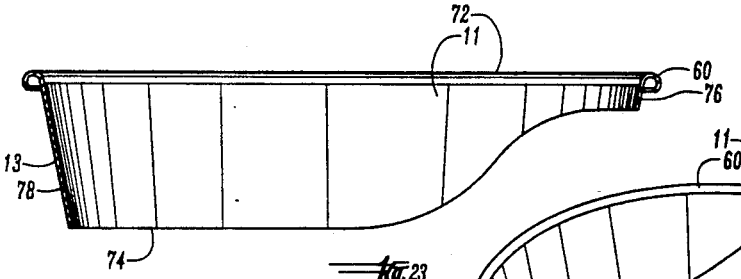
FIG. 23 is an interior sectional view taken along line 23—23 of FIG. 22.

A variation is shown in FIG. 20, in which there are a series of lips 60 providing the mounting means to the rim 14. These may be also seen in the top view in FIG. 21.

By providing that the device is contained within the netting 18, considerable advantages result. With the annular member 10 inside netting 18, one can get a more realistic view of the basketball hoop 12 with the target in place It enhances not only rim 14, but netting 18 as well. Further, when the annular member 10 is inside netting 18, the lip mounting means is easily employed since indentations 70 are all that are required in order to avoid contact with any of the support mechanisms. Such a lip is easy to manufacture and install Thus, with this adaptation, the user of the target device gets a realistic view of the hoop while enhancing the rim and netting together. Thus, the target device will enhance the ability to shoot, while not altering the appearance of basketball hoop 12 as dramatically as when the device is on the outside of netting 18. Translation of skills from practice with the target to without the target is thereby eased.

Figure 22:
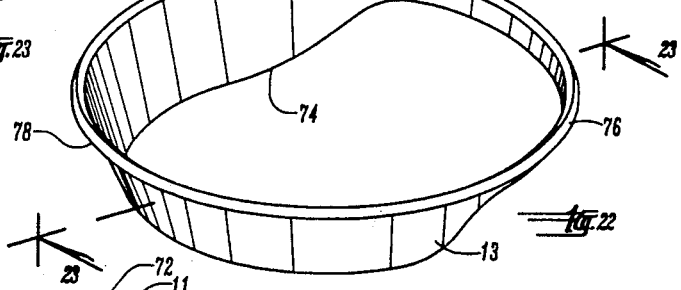
FIG. 22 is a perspective view of an embodiment of the device of this invention.
Figure 25:
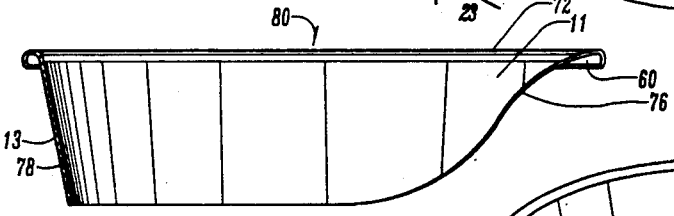
FIG. 25 is an interior sectional view taken along line 25—25 of FIG. 24.
Figure 24:
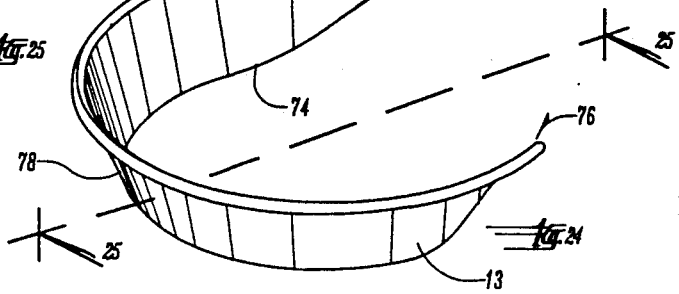
FIG. 24 is a perspective view of an embodiment of the device of this invention.
Figure 26:
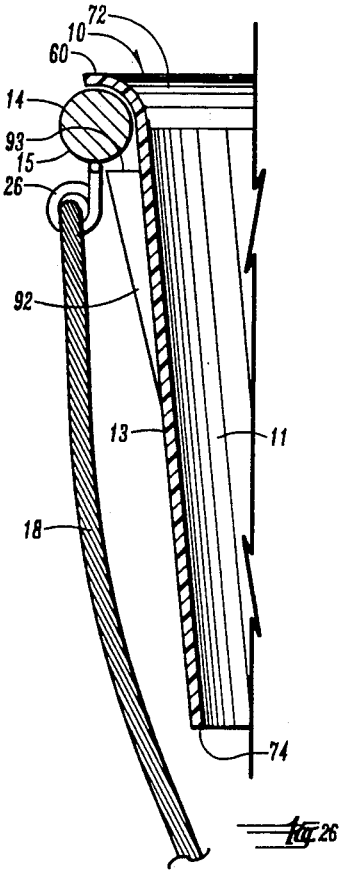
FIG. 26 is a sectional elevational view showing an embodiment of the invention.
Figure 27:
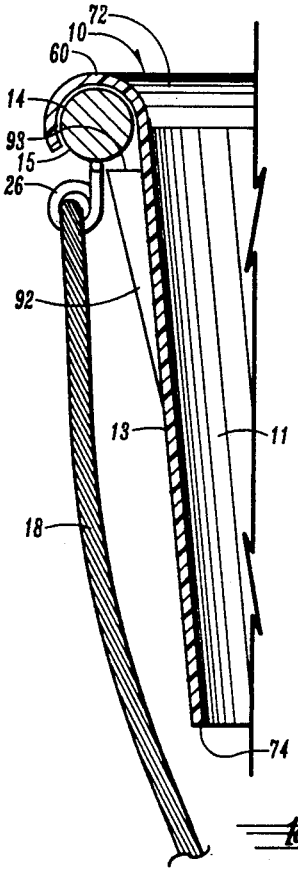
FIG. 27 is a sectional elevational view showing an embodiment of the invention.

Still further variations are depicted in FIGS. 22 through 25. In FIG. 22, there is shown the device where there is included a top 72 and a bottom 74, and a front portion 76 and rear portion 78. The front portion 76 is shorter from top 72 to bottom 74 than at the rear portion 78. This further aids in targeting the hoop, since the rear of the hoop is more easily visible because the rear portion 78 extends further downward than does the front portion 76. An even more exaggerated version of this is shown in FIG. 24, in which the member is actually a partial circle 80. This allows a complete view of the rim at the front, while aiding in targeting the rear portion 78 of the partial circle 80.

There is also depicted an embodiment which eases placement of the device on the basketball hoop. Shown in FIGS. 16, 17, and 19 is a loop 82 attached to the exterior 13 of annular member 10. In this embodiment, the loop 82 is attached to annular member 10 by snaps 84 on either side of loop 82. The loop may be used in conjunction with a pole 86 having an end point 88, and a hook 90. The end point 88 of pole 86 is slipped into loop 82 as can be seen in FIG. 17. The device is then lifted over basketball hoop 12 and brought down within netting 18. The device is attached by contacting lip 60 with rim 14. The hook 90 can aid in this. After removing the pole when the device has been slipped onto basketball hoop 12, hook 90 may then be inserted into loop 82, as seen in FIG. 19. By pulling downward, this aids in snapping the device in place.

One problem that can be encountered in using any of the target devices is that when the basketball enters the basketball hoop 12 with the device in place, the basketball may jolt the device so that the entire device tends to pop upwards. This may be overcome by placing a retaining member underneath any rigid member of the basketball hoop and here is underneath the rim 14, as shown in FIGS. 17, 19, 26 and 27. Here, the retaining member is shown as a wedge 92, since it stops the upward movement of the device when it is hit by a basketball. Wedge 92 is shown in FIGS. 17, 19 and 26, 27 as being generally triangular in shape, with the blunt end 93 positioned underneath rim 14. When the device is forced upward, blunt end 93 contacts rim 14, and prohibits further upward movement of the device. Wedge 92 may have a variety of shapes and may contain therein a resilient spring-like device so that it can be pushed in when mounting the device to the hoop, and will spring back outward when in place. Additionally, many modern basketball hoops replace bracket 64 with a long thin support bar extending from backboard 20 and underneath rim 14. In this case, the retaining member may be positioned under the support bar to stop the upward movement. Clearly, positioning the retaining member under any rigid part of the hoop will serve the purpose intended.

Figure 28:
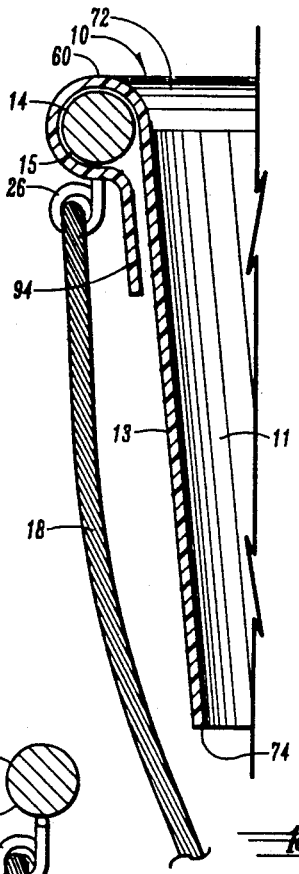
FIG. 28 is a sectional elevational view showing an embodiment of the invention.
Figure 29:
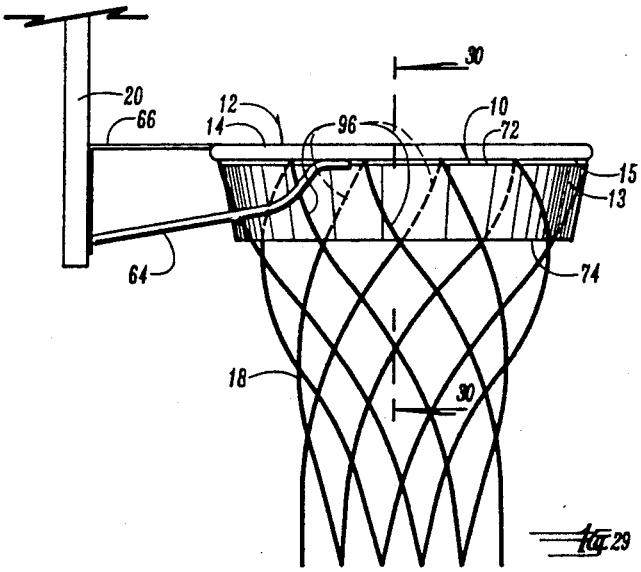
FIG. 29 is a side elevational view of an embodiment of the device of this invention mounted onto a basketball hoop.
Figure 30:
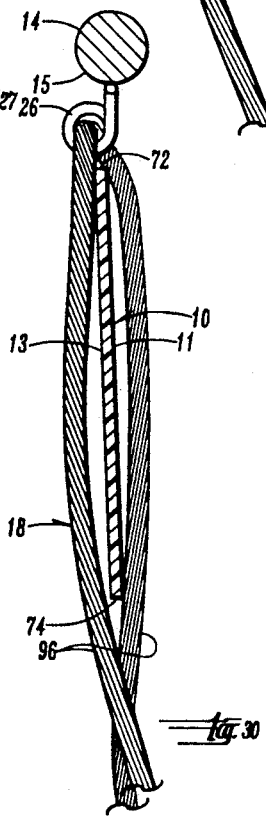
FIG. 30 is a sectional view taken along line 30—30 of FIG. 29.

Also serving the same purpose is the resilient clip 94 depicted in FIG. 28. Here, lip 60 continues outward and around rim 14, and then extends downward as shown at 94 to form a resilient clip. When the device is placed onto the rim, resilient clip 94 is forced outward and then snaps in place when the device is in position. This likewise prohibits the upward movement of the device.

Still further adaptations are shown in FIGS. 29 through 33. Netting 18 forms a series of loops 96, as demonstrated at FIG. 29. Annular member 10 is woven in and out of these loops 96. The loop itself holds the annular member 10 up. In this embodiment, a special netting 18 is provided wherein the loops 96 are shorter at least at this upper most section where the annular member 10 is woven in and out. Because loops 96 are shorter, they force the annular member 10 close to the bottom 15 of rim 14. As shown in the sectional view of FIG. 30, annular member 10 rests within the loops.

Variations and modifications upon the invention, including the means of mounting the annular member to the basketball hoop may be used without departing from the scope or spirit of the invention.

Thus, it can be seen that the invention accomplishes at least all of its objectives.

I claim:

1. A device for use in shooting a basketball into a basketball hoop, the hoop having a rim and a net descending from the rim the net having an inside surface and outside surface, comprising:

a member forming a partial circle; and means for detachably mounting the member to the rim, the mounting means detachably mounted to the rim with the member positioned inside the net so the member provides a visual guide of the rim position when shooting the basketball into the hoop.

2. The device of claim 1 wherein the device has a forward portion and rearward portion, a top and bottom, the forward portion shorter from top to bottom than the rearward portion.

3. A device for use in shooting a basketball into a basketball hoop having a rim and a net descending from the rim, the net having an inside surface and outside surface, the device comprising:

an annular member; and means for detachably mounting the annular member to the rim, with the annular member positioned inside the net so the member provides a visual guide of the rim position when shooting the basketball into the basketball hoop, the annular member having an interior surface and exterior surface, and further comprising a loop attached to the exterior surface of the member, to aid in lifting the device for placement on the basketball hoop.

4. A device for use in shooting a basketball into a basketball hoop having a rim and a net descending from the rim, the net having an inside surface and outside surface, the device comprising:

an annular member having interior and exterior surfaces;

means for detachably mounting the annular member to the rim, with the annular member positioned inside the net so the member provides a visual guide of the rim position when shooting the basketball into the basketball hoop; and a retaining wedge member on the exterior surface of the annular member positioned below the basketball hoop to prohibit the annular member from inadvertent upward movement when in use.

5. The device of claim 4 wherein the annular member has an upper portion and lower portion, the mounting means is a series of extensions upward from the annular member and arching outward from the member to form a series of lips resting on the rim to mount the member to the rim.

6. The device of claim 4 wherein the annular member has an interior surface and exterior surface, and further comprising a loop attached to the exterior surface of the member, to aid in lifting the device for placement on the basketball hoop.

7. The device of claim 4 wherein the retaining member is positioned below the rim of the basketball hoop.

8. The device of claim 4 wherein the wedge includes a resilient member to resiliently force the wedge outward.

9. The device of claim 4 wherein the lip extends around the rim and downward from the rim to form a resilient clip prohibiting inadvertent upward movement of the device when in use.

10. The device of claim 4 wherein the device has an interior surface and exterior surface, the interior surface having a different color than the exterior, surface.

11. The device of claim 4 wherein the device has an interior surface and exterior surface, the interior surface having a different texture than the exterior surface.

12. The device of claim 4 wherein the device has a forward portion and rearward portion, a top and bottom, the forward portion being shorter from top to bottom than the rearward portion.

13. The device of claim 4 wherein the annular member has upper and lower portions, the mounting means extending upward from the annular member and arching outward from the annular member to form a lip adapted to rest on the rim to mount the member to the rim.

14. The device of claim 13 wherein the rim is attached to a backboard by at least one support, the lip having at least one indentation allowing attachment of the device to the rim without interfering with the support.

15. A device for use in shooting a basketball into a basketball hoop having a rim and a net descending from the rim, the net having an inside surface and outside surface, the device comprising:

an annular member;

means for detachably mounting the annular member to the rim with the annular member positioned inside the net so the member provides a visual guide of the rim position when shooting the basketball into the basketball hoop; and the device having an interior surface and an exterior surface, with the interior surface having a different color than the exterior surface.

16. A device for use in shooting a basketball into a basketball hoop having a rim and a net descending from the rim, the net having an inside surface and outside surface, the device comprising:

an annular member;

means for detachably mounting the annular member to the rim, with the annular member positioned inside the net so the member provides a visual guide of the rim position when shooting the basketball into the basketball hoop; and the device having an interior surface and an exterior surface, with the interior surface having a different texture than the exterior surface.

17. A device for use in shooting a basketball into a basketball hoop having a rim and a net descending from the rim, the net having an inside surface and outside surface, the device comprising:

an annual member;

means for detachably mounting the annular member to the rim, with the annular member positioned inside the net so the member provides a visual guide of the rim position when shooting the basketball into the basketball hoop; and the device having a forward portion, a rearward portion, a top, and a bottom, the forward portion being shorter from top to bottom than the rearward portion.

* * * * *